United States Patent [19]

Sand

[11] Patent Number: 5,066,255

[45] Date of Patent: Nov. 19, 1991

[54] DRIVE ARRANGEMENT FOR A PLANING BOAT

[76] Inventor: Roland Sand, Hintere Strasse 40, 6729 Neupotz, Fed. Rep. of Germany

[21] Appl. No.: 541,063

[22] Filed: Jun. 20, 1990

[30] Foreign Application Priority Data

Jul. 11, 1989 [EP] European Pat. Off. ..... 89112617.9

[51] Int. Cl.[5] ..... B63H 23/36

[52] U.S. Cl. ..... 440/112; 440/66

[58] Field of Search ..... 440/38, 40, 66, 57, 440/58-63, 111, 112

[56] References Cited

U.S. PATENT DOCUMENTS

| | | | |
|---|---|---|---|
| 2,096,223 | 10/1937 | Chandler et al. | 440/66 |
| 2,860,594 | 11/1958 | Kiekhaefer | 440/66 |
| 3,768,432 | 10/1973 | Spaulding | 440/66 |

*Primary Examiner*—Jesus D. Sotelo

[57] ABSTRACT

In a drive arrangement for a planing hull boat in which a drive shaft extends from a motor within the hull through the stern wall to a propeller arranged in a tunnel-shaped water flow guide structure extending backwardly from the bottom edge of the stern wall and upwardly in a curved fashion, the propeller is mounted so as to be rotatable about an axis which is essentially parallel to and in alignment with the hull bottom. The flow guide structure has a top end section hinged so as to be tiltable about a horizontal axis between the guide structure side walls and, at its front end adjacent the rear hull bottom edge, a scoop adapted to scoop up a stream of water which is directed over the flow guide structure to form a water seal preventing in leakage of air into the water flowing through the flow guide structure.

8 Claims, 2 Drawing Sheets

DRIVE ARRANGEMENT FOR A PLANING BOAT

BACKGROUND OF THE INVENTION

The invention relates to a drive arrangement for a planing boat which includes a motor with a drive shaft extending through the rear wall of the boat at an acute angle with respect to the water surface and carrying at its end a propeller which is arranged in a downwardly open, sidewardly pivotable, tunnel-like flow guide housing.

Such drives as shown for example in German Patent 3042197 have proved themselves quite well in practice since they permit highly efficient utilization of the given motor power and provide for excellent boat acceleration as well as high top speed.

It is the principal object of the present invention to improve the boat drive shown in German Patent 3042197, particularly to maximize the drive-influenced planing characteristics of a boat provided with such a drive.

During operation a planing boat by the design of its hull is subject to a dynamic-force generated lift which with increasing boat speed lifts the boat out of the water so that, at higher speeds, only the rear end of the boat is in contact with the water. This results in a substantially reduced resistance so that such boats can achieve relatively high speeds. It is noted that the reduction in resistance of planing boats is essential for reaching such high speeds. Consequently anything in the drive arrangement that may impair the resistance reduction or that may generate unnecessary resistance must be avoided. Particularly underwater components of the drive, if needed, must have a streamlined shape. For low resistance it is also advantageous if the hull bottom portions remaining in contact with the water are disposed at as small an angle as possible when the boat is gliding on the water surface. This angle however is determined to a large extent by the position and the kind of the boat drive. If as usual the drive is arranged low, that is, lower than the bottom of the boat, the drive force generates a large moment which tends to lift the bow and thereby prevents the boat from assuming its optimal planing angle with respect to the water surface. The boat planing angle can be corrected by trimming but only with some drive power losses. The same is true if the drive, that is, the propeller, is arranged at about the same level as the hull bottom as in the arrangement according to German Patent 3042197 but the drive shaft is arranged at an angle with respect to the hull bottom and the water tunnel extending to the rear and receiving the propeller is parallel to the drive shaft. In this case a negative moment is generated by the drive force which tends to push the bow down onto the water surface and this situation cannot be corrected by trimming of the outer drive structure. Since with such a direct shaft drive arrangement the angle of the drive shaft with respect to the water surface is inherently relatively large, that is, the propeller is not disposed in a plane normal to the water surface, the downwardly and upwardly moving propeller blades are at slightly different angles with respect to the water flow, that is, the downwardly moving blades are at a somewhat larger pitch than the upwardly moving blades which phenomenon reduces propeller efficiency and generates some high frequency vibration.

The best solution would be a drive which generates a drive force that is essentially in alignment with the hull bottom. This would avoid the need for trimming or other resistance inducing underwater components since all the resistance of a planing boat is generated at the hull bottom.

SUMMARY OF THE INVENTION

A drive arrangement for a planing hull boat has a drive shaft extending from a motor within the hull through the stern wall of the hull to a propeller arranged in a tunnel-shaped water flow guide structure extending backwardly from the bottom edge of the stern wall and upwardly in a curved fashion. The propeller is mounted against the rear end of the tunnel-shaped structure such that it is rotatable about an axis which is essentially parallel to, and in alignment with, the hull bottom thereby generating a propulsion force which, during planing of the boat, is essentially in alignment with the bottom surface area where all the resistance is generated. The flow guide structure has a top end section hinged so as to be tiltable between the guide structure side walls about a horizontal axis and at its front end adjacent the rear hull bottom edge has a scoop adapted to scoop up a stream of water which is directed over the flow guide structure so as to form a water seal that prevents in leakage of air into the water flowing through the guide structure to the propeller.

With this drive arrangement it is possible to arrange the propeller in a vertical plane, that is, in a plane normal to the bottom plane of the boat hull, so that the drive force generated by the propeller extends parallel to or in a plane extending along or even somewhat above the bottom surface of the boat hull. As a result on planing, the hull bottom in contact with the water will be at a very small angle with respect to the water surface so that the boat will glide on the water surface with little resistance and the propeller will operate with maximum efficiency and without detrimental vibrations since the propeller plane is then normal to the direction of boat travel. However, in order to provide for greatest operating efficiency, it is imperative that no air is sucked into the water stream passing through the propeller since such an event would instantly lower propeller operating efficiency. Ingestion of air however has been difficult to avoid with prior drive arrangements since such planing motor boats are steered by pivoting the boat drive. Such pivotability is achieved among others by providing in the drive arrangement a gap through which however air may be ingested. The ingestion of efficiency reducing air is avoided in accordance with a preferred embodiment of the invention by providing a gap between the rear hull bottom edge through which a water stream is scooped up and conducted over the top surface of the flow guide structure which stream safely prevents the ingestion of air through any openings or gaps in the top portion of the flow guide structure.

All together the drive arrangement according to the invention is very efficient since it includes no unnecessary resistance generating underwater components, since no air can be ingested by the water column accelerated by the propeller, since the propeller is arranged in a plane normal to the direction of boat movement so that propeller efficiency is maximized and since the propeller drive force is parallel to and slightly above the boat bottom surface.

With regard to the joint in the drive shaft or the transmission there are various possibilities. It is proposed in accordance with the invention that the joint is a constant velocity joint combined with the propeller support bearing structure, or if the angle between the drive shaft axis and the propeller axis is only small it may be a curved teeth gear coupling. If a transmission is employed, a universal joint arranged outside the hull is preferably combined with a geared transmission disposed generally outside the water duct housing such that the driving gear is disposed above the driven gear which is mounted to one end of a propeller shaft whose other end carries the propeller. The propeller shaft is so arranged that it is in alignment with the desired force direction of the drive, any angular deviation being accommodated by the universal joint. The gear transmission may consist of spur gears or, if relatively large angles have to be accommodated, of bevel gears. The flow guide housing structure should start with a scoop beginning slightly behind the rear hull bottom edge with an upper wall, following in cross-section, a hyperbolic shape beginning in the direction of the hull bottom surface and curving up and rearwardly to form a duct structure for the water column to be accelerated by the propeller which provides for little flow resistance and uniform incident flow to the propeller providing for high operating efficiency.

The water scooped up during planing of the boat and directed over the flow guide housing flows around and cools the transmission casing if a transmission is utilized and also provides for exhaust noise muffling if a splash cover is arranged above the housing. The cover is disposed above the outside universal joint and defines a space receiving the engine exhaust gas from an exhaust pipe terminating in this space. In this space a water spray of relatively large water droplets is generated which act as excellent sound deadeners so that the exhaust noise becomes barely noticeable.

In order to permit trimming of the boat the tunnel-like housing of the drive according to the invention is mounted tiltably about a horizontal axis which extends through the center of the outside universal joint. In this manner the drive can be adjusted so as to provide for the ideal force direction with respect to the hull bottom surface. Fine trimming can be performed by angle adjustment of the top end portion of the tunnel housing above the propeller about a horizontal axis which is disposed about above the propeller shaft end bearing, the tunnel housing top end portion being sealed with respect to the tunnel housing side walls. The accelerated weather jet following the tunnel contour is deflected thereby to the degree as desired for adjustment of the hull orientation relative to the water surface.

SHORT DESCRIPTION OF THE DRAWINGS

FIG. 1 shows an embodiment of the drive arrangement with constant velocity joint in the propeller; and FIG. 2 shows an embodiment with a spur gear transmission in the drive arrangement.

DESCRIPTION OF THE PREFERRED EMBODIMENTS

Figure 1:
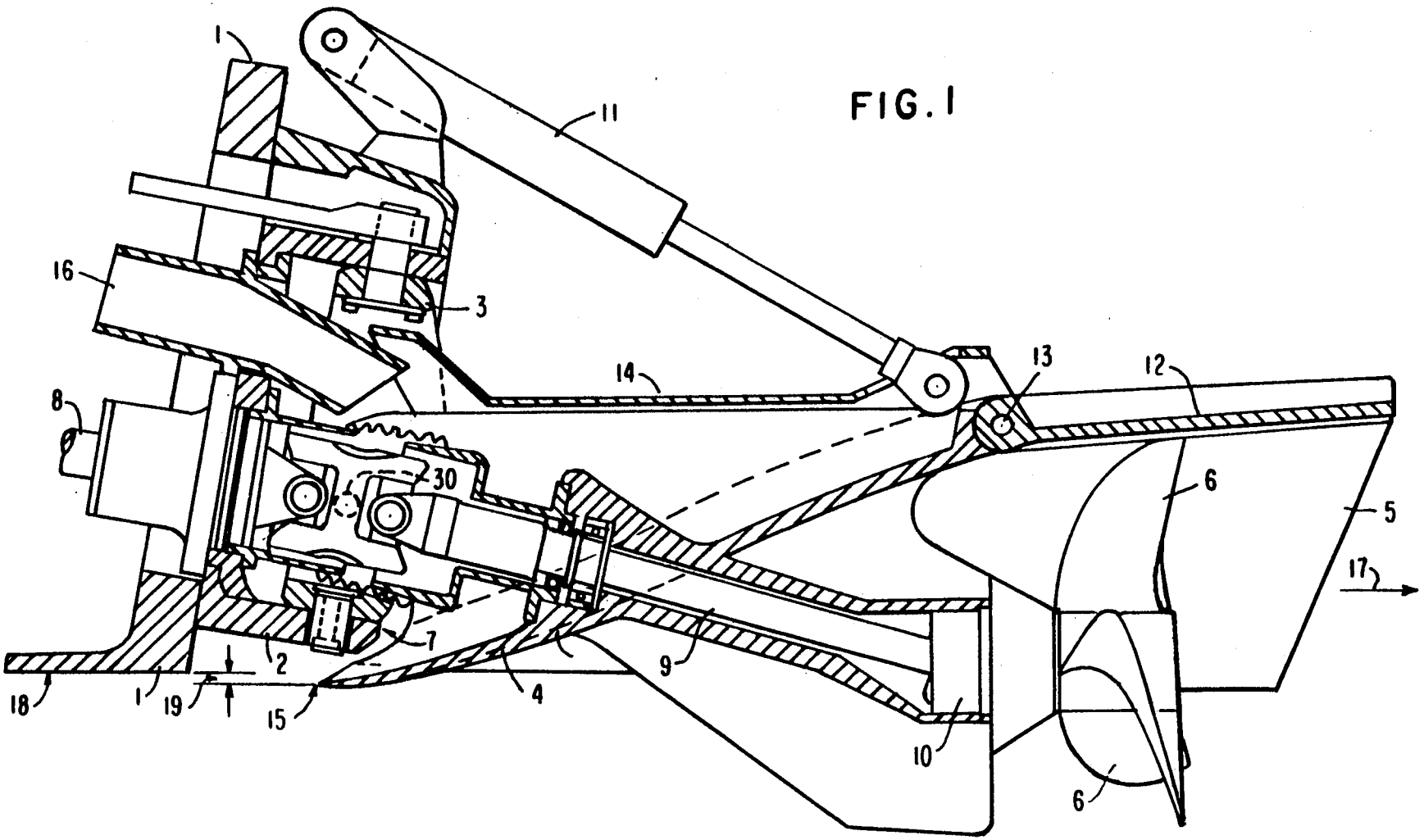

As shown in FIG. 1 a drive is mounted on the stern wall 1 of a planing boat by way of a support structure 2 having a gimbal ring mounted therein so as to be pivotal about an upright axis extending parallel to the stern wall 1. Within the gimbal ring 3 a tunnel-shaped housing 4 is mounted on horizontal support studs 30 projecting inwardly from opposite sides of the gimbal ring 3, which housing 4 has at its forward lower end a knife-like scoop 15 and a wall portion 5 extending from the scoop 15 back and upwardly following in cross-section a hyperbolic shape so as to form a tunnel-like water flow guide duct structure projecting beyond the propeller 6 which is rotatably supported therein. The propeller 6 is connected to the boat engine drive shaft 8 by way of an intermediate shaft 9 coupled to the drive shaft 8 by a double universal joint 7 disposed centrally between the housing support studs 3*a*, and to the propeller by way of a coupling 10 which may be a curved teeth coupling or a constant velocity joint. The housing 4 with water guide duct structure 5 and propeller 6 and intermediate shaft 9 can be tilted about its horizontal articulated support 3*a* by means of a hydraulic operating cylinder 11. Tilting of the housing structure is utilized for rough trimming of the boat as well as for lifting the drive, for example, during trailering of the boat or for changing the propeller. Fine trimming can be performed by adjustment of a top wall duct end section 12 which is hinged to the housing wall 5 so as to be tiltable about a horizontal axis 13 and operable, for example, by an additional hydraulic operating cylinder (not shown). The figures also show a spray cover 14 arranged above the housing 4 and covering the drive arrangement beginning from the housing scoop 15 back to the point 11*a* where the hydraulic operating cylinder 11 is linked to the housing 4. It defines a space above the guide duct structure 5 in which the outer universal joint 7 is disposed and in which the engine exhaust pipe 16 terminates.

In contrast to the usual drives of the type described, also in contrast to the drive disclosed in German Patent 3042197, the propeller plane of the propeller 6 is disposed in a normal plane with respect to the water surface which results in optimal operating efficiency for the propeller 6. This is achieved by mounting the propeller in the housing extension 4*a* by a bearing structure having an axis parallel to the water surface but at an angle to the intermediate drive shaft 9 and connecting the intermediate shaft 9 to the propeller by way of the universal joint 10.

During operation of the boat the propeller 6 sucks water into the tunnel-shaped guide duct structure 5 and ejects the water to the rear as indicated by arrow 17. At the same time, water is scooped up by the scoop 15 which is disposed slightly lower than the rear bottom edge of the boat hull as indicated at 19 such that a stream of water flows over the guide duct structure 5, which flow not only seals off the guide duct structure to prevent air leaks into the water tunnel but which also cools the drive shaft bearings and universal joints 7. The water flow over the guide structure also generates a water spray filling the whole space between the guide duct structure 5 and the spray cover 14 with relatively large water droplets which act as an excellent sound muffler so that the exhaust noise from the exhaust pipe 16 is hardly noticeable.

Figure 2:
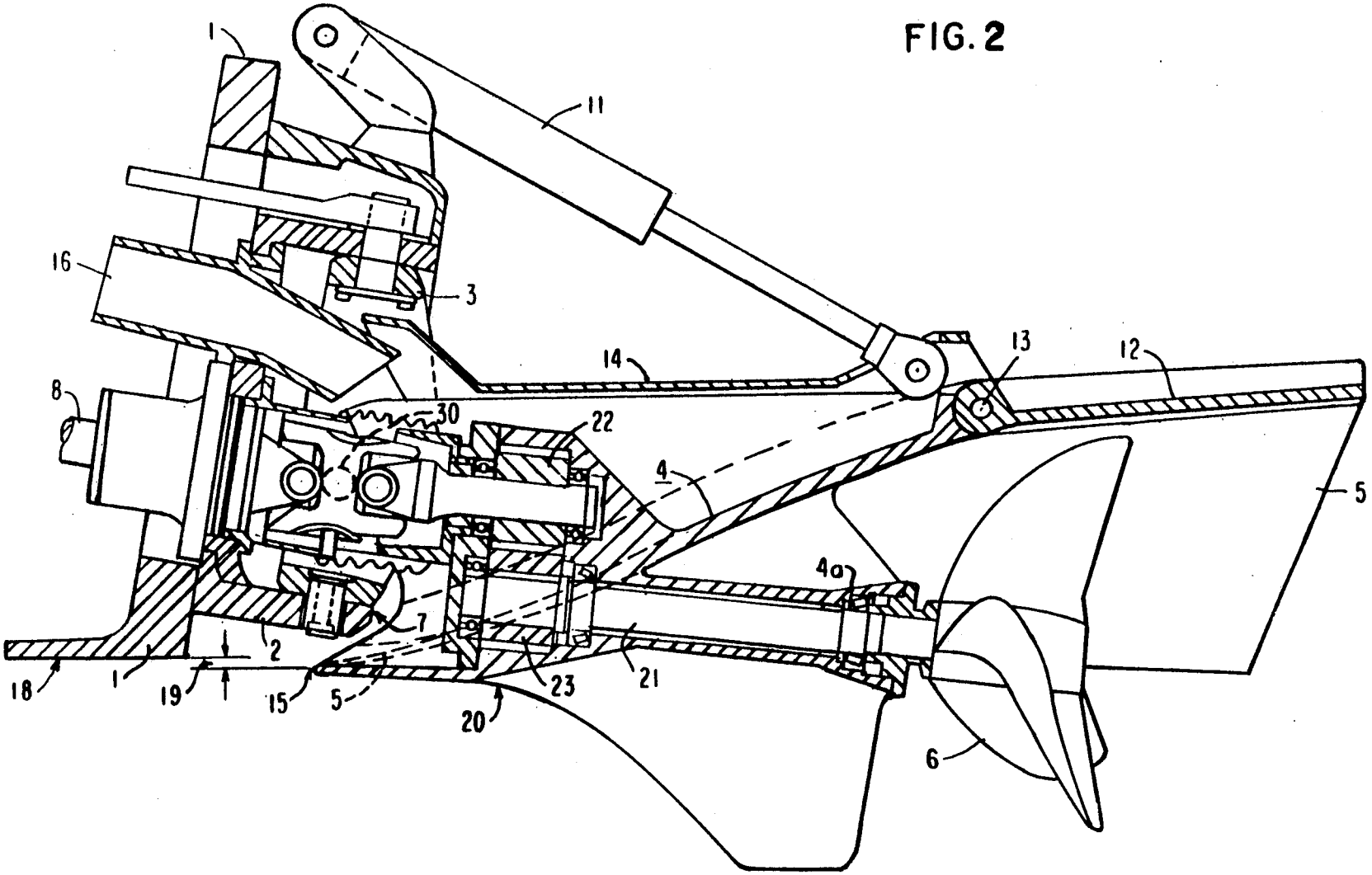

FIG. 2 shows an arrangement similar to FIG. 1 wherein, however, a transmission 20 is arranged adjacent the universal joint 7, a propeller shaft 21 extending between the transmission and the propeller 6. The transmission gears are disposed on top of one another, the upper gear being connected to the drive line from the boat motor and the lower gear being connected to the propeller shaft 21. This arrangement lowers the front end of the propeller shaft to such a degree that the propeller 6 is disposed almost in a vertical plane even if it is directly mounted on the shaft 21 as shown in FIG.

2. The transmission shown is a spur gear transmission. The small change in drive shaft axial orientation can be accommodated by the universal joint 7. If the propeller plane is to be disposed in a plane exactly normal to the water surface, a somewhat larger bevel gear structure may be utilized in place of the spur gear transmission shown.

It is noted however that the major portion of the transmission is disposed outside the water flow tunnel so that only minor flow resistance is generated by the transmission housing.

Tests with planing boats equipped with drives according to the invention show that the arrangement indeed provides for an optimum boat drive which, utilizing all the features of the present invention, is not only operating effectively but also permits to position a boat hull ideally with regard to the water surface for low resistance operation.

What is claimed is:

1. A drive arrangement for a planing hull boat having a motor arranged within the hull, a drive shaft extending from said motor through the stern wall of said hull and including at least one universal joint disposed outside said hull, a tunnel-shaped water flow guide structure extending backwardly from the bottom edge of said stern wall and upwardly in a curved fashion, a propeller supported in said tunnel-shaped water flow guide structure adjacent the rear end thereof so as to be rotatable about an axis which is essentially parallel to and in alignment with the planing hull bottom surface and which is operatively connected to said drive shaft by way of an intermediate shaft with an additional joint, said tunnel-shaped water flow guide structure having side wall sections and a top end section above said propeller hinged so as to be tiltable about a horizontal axis and disposed in sealing relationship with respect to the side wall sections, the front end of said tunnel-shaped water flow guide structure defining a gap which is open in the direction of movement of said boat and forming a scoop adapted to scoop up a stream of water during operation of the boat, which stream is directed over said flow guide structure thereby forming a water seal preventing any air leakage into said tunnel-shaped water flow guide structure.

2. A drive arrangement according to claim 1, wherein said additional joint is a constant velocity joint arranged in the propeller bearing structure.

3. A drive arrangement according to claim 1, wherein said additional joint is a curved teeth coupling.

4. A drive arrangement according to claim 1, wherein said outer universal joint has a gear transmission associated therewith with a drive gear disposed above a driven gear, said transmission having a housing arranged essentially outside said water flow guide structure and said driven gear having said intermediate propeller drive shaft connected thereto inside said water flow guide structure.

5. A drive arrangement according to claim 4, wherein said gear transmission is a spur gear transmission.

6. A drive arrangement according to claim 4, wherein said housing beginning with said scoop follows in shape the hull bottom and extends rearwardly and upwardly with said top wall in cross-section essentially in hyperbolic shape.

7. A drive arrangement according to claim 6, wherein said scoop is arranged at a slightly lower level than the hull's bottom rear edge.

8. A drive arrangement according to claim 1, wherein a splash cover is disposed above said water flow guide structure and above said one universal joint defining a space therebetween, the motor of said boat having an exhaust pipe terminating in said space.

* * * * *